US006682329B1

(12) United States Patent
Patel et al.

(10) Patent No.: US 6,682,329 B1
(45) Date of Patent: Jan. 27, 2004

(54) COOLING OF HYBRID SCROLL COMPRESSOR WRAP BY SUCTION PRESSURE GAS PASSAGES

(75) Inventors: Tapesh P. Patel, Hotsprings, AR (US); Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/336,591

(22) Filed: Jan. 3, 2003

(51) Int. Cl.[7] ..... F04C 18/04

(52) U.S. Cl. ..... 418/55.2; 418/55.4; 418/55.6; 184/6.18

(58) Field of Search ..... 418/55.2, 55.4, 418/55.6; 184/6.18

(56) References Cited

U.S. PATENT DOCUMENTS 5,458,471 A * 10/1995 Ni ..... 418/55.2
5,833,443 A * 11/1998 Lifson ..... 418/55.2
6,142,753 A * 11/2000 Bush et al. ..... 418/55.1
6,196,816 B1 * 3/2001 Lifson et al. ..... 418/55.6
6,318,982 B1 * 11/2001 Fujii et al. ..... 418/55.2

FOREIGN PATENT DOCUMENTS

GB 2167132 A * 5/1986 ..... F04C/2/04
JP 04022781 A * 1/1992 ..... F04C/18/02

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A cooling passage is formed through the wrap of a non-orbiting scroll. The cooling passage communicates with suction pressure refrigerant and passes the suction pressure refrigerant through both the base and the wrap of the non-orbiting scroll to cool an interface between suction pressure chamber and discharge pressure chambers. Preferably the cooling passage extends for a relatively great circumferential extent, and preferably more than 45°. More preferably the passage extends for more than 90°. The cooling passage provides a heat barrier increasing the efficiency of compression. Moreover, by having the suction pressure flow to the interface between the thicker portion of the wrap and the opposed base of the orbiting scroll, several benefits are obtained with regard to reliable operation of the scroll compressor.

12 Claims, 2 Drawing Sheets

COOLING OF HYBRID SCROLL COMPRESSOR WRAP BY SUCTION PRESSURE GAS PASSAGES

BACKGROUND OF THE INVENTION

This application relates to an improvement in hybrid wrap scroll compressors wherein a suction pressure gas is passed through a thick portion of the wrap and between lower pressure and higher pressure compression chamber pockets. This gas cools the thickened portion of the wrap.

Scroll compressors are becoming wildly utilized in refrigerant compression applications. In a scroll compressor, a pair of interfitting scroll members each have a base and a generally spiral wrap extending from the bases. The wraps interfit to define compression chambers. One of the two scroll members is caused to orbit relative to the other, and as the two orbit relative to each other, the wraps compress an entrapped refrigerant in the compression chambers. The scroll compressor has become more successful due to the increased efficiency.

Originally, a scroll compressor wrap was formed of a generally uniform thickness, and essentially on an involute of a circle. More recently, and as the design of scroll compressors has become more sophisticated, so called "hybrid" wraps have been developed. In a hybrid wrap, the scroll wrap is defined by a complex curve, or even a series of curves. The thickness of the wrap also varies along a circumferential direction of the wrap.

In scroll compressors, the compression of the refrigerant generates a good deal of heat. Further, the scroll members are generally formed of a metal which is a good conductor for heat transfer. Thus, the scroll wraps will transfer heat from inner compression chambers radially outwardly to the outer peripheral surface of the wrap which may be in contact with the suction pressure refrigerant, and the suction pressure chamber. This is undesirable, and can result in efficiency losses.

Also, since the thickened portion of the wrap tends to have a good deal of contact surface, by heating the portion, other problems such as pinching, galling, etc. can occur.

SUMMARY OF THE INVENTION

In the disclosed embodiment of this invention, a cooling passage is formed through a thick portion of a hybrid scroll wrap. The cooling passage preferably communicates with suction pressure refrigerant, and extends entirely through the base of the scroll member. The cooling passage communicates suction pressure refrigerant through the wrap to the opposed interface between the wrap and the base of the other scroll member. Most preferably, this cooling passage is formed through the nonorbiting scroll.

The passage thus communicates low temperature refrigerant through a portion of the wrap which had served as a large source of heat transfer between the compression pressure chambers and suction pressure chambers. The passage thus acts as a heat barrier, preventing the transmission of the heat to the suction pressure chambers. This provides efficiency gains for the overall compression process.

Other benefits of this invention include the reduction of the contact surface area between the thick portion of the hybrid wrap and the opposed base. Also, the tip galling and pinching which has occurred with distortion of the thicker portion is also reduced. Further, by passing the lubricant carrying suction refrigerant to the interface, lubrication is provided to an area that has been somewhat difficult to lubricate in the past.

These and other features of the present invention can be best understood from the following specification and drawings, the following of which is a brief description.

DETAILED DESCRIPTION OF THE PREFERRED EMBODIMENT

Figure 1:
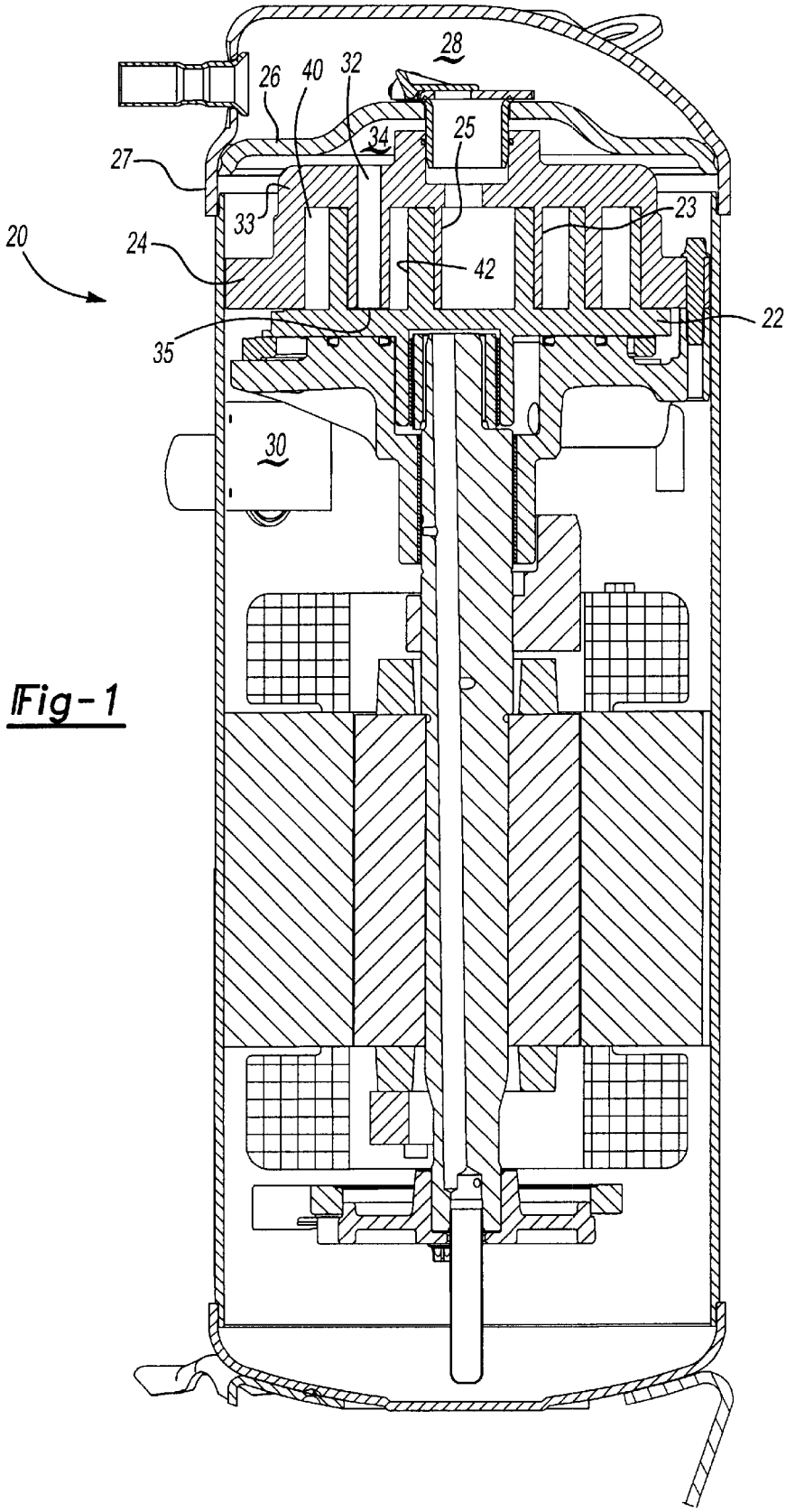
FIG. 1 is a cross-sectional view through the inventive scroll compressor.

FIG. 1 shows a scroll compressor 20 having an orbiting scroll 22 and a non-orbiting scroll 24. A separator plate 26 is mounted within a housing 27 and defines a separation point between a discharge pressure chamber 28 and a suction pressure chamber 30. The orbiting scroll 22 carries a hybrid scroll wrap 23, and the non-orbiting scroll 24 carries its own hybrid wrap 25. As is clear from this cross-section, the thickness of the wraps varies along the circumferential length of the wrap. The general structure of the hybrid wrap may be as known.

A passage 32 extends through the base 33 of the non-orbiting scroll 24 to communicate with a pocket 34 which is at suction pressure, and which communicates with the suction chamber 30. Now, refrigerant can pass through the passage 32 to the interface 35 between the wrap 23 and the base of the orbiting scroll member 22. The present invention is preferably utilized in a non-orbiting scroll wrap although the invention may also have some application in the wraps of an orbiting scroll.

Figure 2:
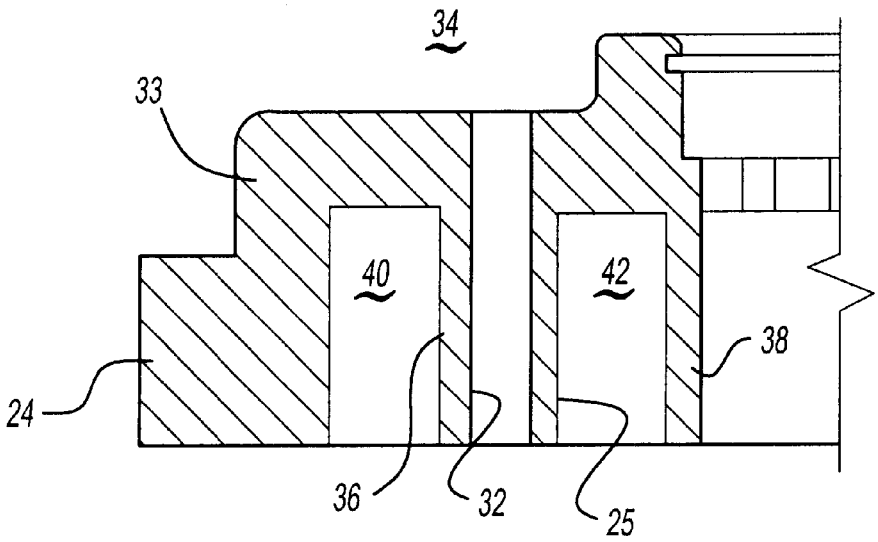
FIG. 2 is a partial view through the non-orbiting scroll of the present invention.

FIG. 2 shows the non-orbiting scroll 24, and the passage 32 extending entirely through both the wrap 25, and the base 33. As can be understood, refrigerant from the chamber portion 34 will pass through the passage 32 down into the interface 35 at the bottom-of the wrap 25. This refrigerant could carry lubricant to lubricate the interface surfaces. Further, the cooler suction pressure refrigerant provides a heat barrier, preventing transmission of heat from the inner discharge pressure chamber 42 to the outer cooler suction pressure chamber 40. This will provide the efficiency benefits mentioned above.

Figure 3:
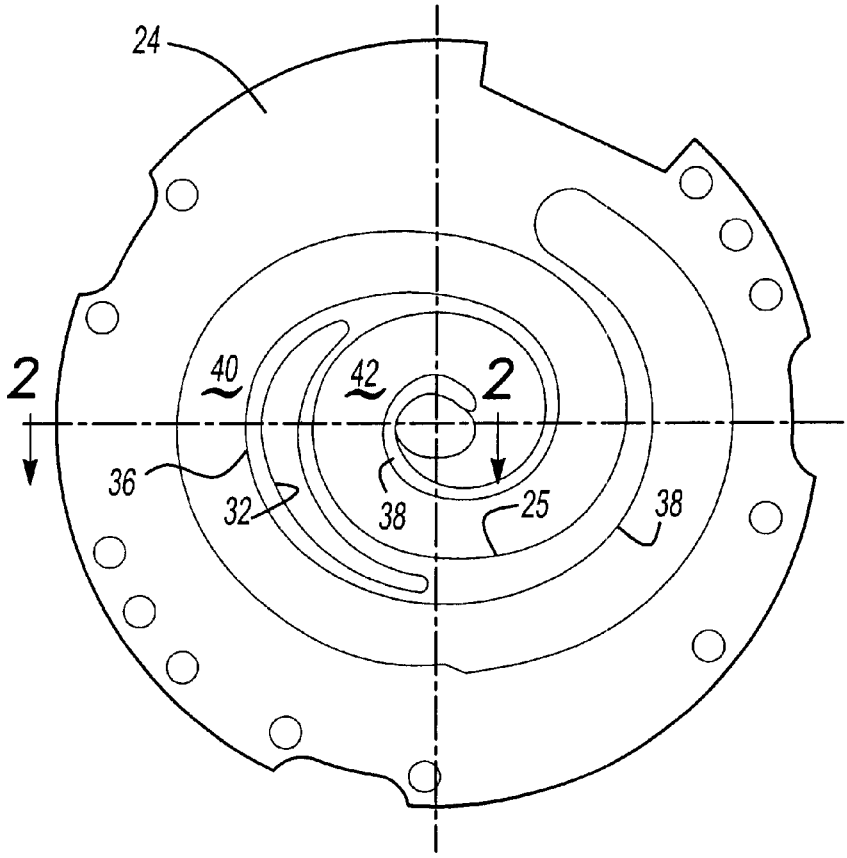
FIG. 3 is a top view of a non-orbiting scroll incorporated into the present invention.

FIG. 3 is a sectional view of the non-orbiting scroll wrap 24. As is clear, there are thicker portions such as shown at 36, and the thinner portions such as shown at 38. The passage 32 is formed in one of the thicker portions, and extends for a good deal of circumferential distance about a central axis. Preferably, the passage extends for more than 20°, more preferably for more than 45°, more preferably for more than 90°, and most preferably for an angle of approximately 120°, as shown in the attached drawing. Also, while a single passage portion is preferred, it is also possible to have several discrete passage portions forming the "passage."

By communicating the suction pressure refrigerant through the passage 32, benefits as mentioned above are achieved.

Although preferred embodiments of this invention have been shown, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base, said generally spiral wrap being a hybrid wrap having a non-uniform thickness, and including a thicker portion adjacent a radially outward location;

a second scroll member having a base and a generally spiral wrap extending from its base, said generally spiral wrap a hybrid wrap having a non-uniform thickness, and including a thicker portion adjacent a radially outward location, said wraps of said first and second scroll members interfitting to define compression chambers, with radially outward chambers being at a lower suction pressure, and radially inner chambers being at a higher compressed pressure;

said second scroll member being driven to orbit relative to said first scroll member; and said first and second scroll members being placed within a sealed housing, said sealed housing having a discharge pressure chamber separated from a suction pressure chamber, and said suction pressure chamber communicating with a passage through said base and a thicker portion of said wrap of one of said first and second scroll members to communicate suction pressure refrigerant through said base and said wrap to an interface with said wrap and an opposed base of the other of said first and second scroll members.

2. A scroll compressor as recited in claim 1, wherein said cooling passage is formed through said base and said thicker portion of said wrap of said first scroll member.

3. A scroll compressor as recited in claim 2, wherein said cooling passage extends for at least 20° about a central axis of said non-orbiting scroll.

4. A scroll compressor as recited in claim 2, wherein said cooling passage extends for at least 45° about a central axis of said non-orbiting scroll.

5. A scroll compressor as recited in claim 2, wherein said cooling passage extends for more than 90°.

6. A scroll compressor as recited in claim 2, wherein said cooling passage extends for about 120°.

7. A scroll compressor as recited in claim 2, wherein a separator plate defines said suction pressure and said discharge pressure chambers, said separator plate being positioned spaced from said base of said first scroll member such that said suction pressure chamber surrounds an opposed face of said base of said first scroll member to allow communication of said suction pressure refrigerant through said cooling passage.

8. A scroll compressor comprising:

a non-orbiting scroll having a base and a generally spiral wrap extending from said base, said generally spiral wrap being a hybrid wrap such that it has a non-uniform thickness in a radial direction, with a generally thicker portion being positioned at a generally radially outward position;

an orbiting scroll having a base and generally spiral wrap extending from its base, said generally spiral wrap being a hybrid wrap such that it has a non-uniform thickness in a radial direction, with a generally thicker portion being positioned at a generally radially outward position;

said wraps of said orbiting and non-orbiting scroll members interfitting to define compression chambers, with a lower suction pressure chamber being defined radially outwardly of said thicker portion and a more compressed pressure chamber being positioned radially inwardly of said thicker portion;

a separator member positioned spaced from said base of said non-orbiting scroll to define suction pressure and discharge pressure chambers within a housing receiving said orbiting and non-orbiting scroll members; and a cooling passage extending through said base and said hybrid wrap of said non-orbiting scroll at said thicker portion.

9. A scroll compressor as recited in claim 8, wherein said cooling passage extends for at least 20° about a central axis of said non-orbiting scroll.

10. A scroll compressor as recited in claim 8, wherein said cooling passage chamber extends for at least 45° about a central axis of said non-orbiting scroll.

11. A scroll compressor as recited in claim 8, wherein said cooling passage extends for more than 90°.

12. A scroll compressor as recited in claim 8, wherein said cooling passage extends for about 120°.

* * * * *